United States Patent [19]

Gillmer

[11] 4,416,639

[45] Nov. 22, 1983

[54] MANAGEABLE SAFETY DINGHY

[76] Inventor: Thomas C. Gillmer, 1 Shipwright Harbor, Annapolis, Md. 21401

[21] Appl. No.: 275,912

[22] Filed: Jun. 22, 1981

[51] Int. Cl.[3] ..... B63H 16/06

[52] U.S. Cl. ..... 440/106; 114/39; 114/363; 114/123; 114/364

[58] Field of Search ..... 440/106–109; 114/39, 61, 123, 219, 68, 343, 345, 347, 348, 357, 360, 364, 363

[56] References Cited

U.S. PATENT DOCUMENTS

| | | | |
|---|---|---|---|
| 1,213,233 | 1/1917 | Morton | 440/106 |
| 3,026,839 | 3/1962 | Fridge | 114/219 |
| 3,688,728 | 9/1972 | Leperer | 114/219 |
| 3,694,836 | 10/1972 | Serra | 114/345 |
| 3,959,837 | 6/1976 | Archibald | 114/39 |
| 4,068,611 | 1/1978 | Leather | 114/39 |
| 4,082,049 | 4/1978 | Nicol | 114/345 |
| 4,357,894 | 11/1982 | Kirk | 114/363 |

FOREIGN PATENT DOCUMENTS

| | | | |
|---|---|---|---|
| 141299 | 4/1920 | United Kingdom | 114/360 |

*Primary Examiner*—Trygve M. Blix
*Assistant Examiner*—Stephen P. Avila
*Attorney, Agent, or Firm*—Walter G. Finch

[57] ABSTRACT

This invention is an improved dinghy for tending yachts and for similar purposes. The use and operation of dinghies usually entails various problems. In the prior art the managing of the loading of passengers and of gear, and at the same time maintaining a good rowing trim, has had numerous problems. The fixed oarlock sockets of the prior art have precluded efficient seating of passengers and the loading of gear, generally resulting in a poor rowing trim. At the same time, dinghies of the prior art have had less than an adequate bouyancy to enable the vessel to remain afloat in the event of a capsize. The present invention provides an adjustable oarlock device that improves the management of the loading of passengers and gear in a manner that results in an improved rowing trim. The dinghy is provided with a flotation collar, or pneumatic sponson, that provides positive bouyancy. The collar also adds stability by providing a righting moment when submerged, thus improving the safety characteristics. The collar also acts as a bumper to protect the dinghy and other vessels from damage during towing, docking, boarding, and stowing. The flotation collar is located on the exterior of the dinghy near the gunwale stringer and suitably affixed to the exterior surface of the vessel.

14 Claims, 5 Drawing Figures

MANAGEABLE SAFETY DINGHY

BACKGROUND AND SUMMARY OF THE INVENTION

The invention relates to water borne vessels, such as ships and boats, and in particular to yacht tenders. Specifically the invention relates to management features and safety measures for tenders such as dinghies.

In the prior art the loading of passengers and gear in a dinghy often interfered with the maintenance of good rowing trim, because of the fixed position of the oarlocks. The present invention provides an adjustable oarlock means that gives flexibility when loading passengers and gear so that a good rowing trim can be managed and maintained.

Coupled with the need to maintain a good rowing trim is the need for safety during operation. In the prior art, positive bouyancy often was precarious, sometimes the vessel would capsize or sink.

In the present invention a flotation collar, or pneumatic sponson, is a novel and unique device that serves at least three functions in a yacht tender or dinghy. The flotation collar provides a positive bouyancy which enables the vessel to remain afloat in the event of a capsize. The flotation collar also adds to the stability by providing a righting moment when submerged. Thus, the adjustable oarlock means and the flotation collar provide a management capability and a safety capability. The flotation collar also provides a bumper means to protect both the dinghy and other vessels from damage during towing, docking, boarding, and stowing.

The adjustable oarlock means adjusts longitudinally with the vessel's fore and aft axis so that it can be set at the most advantageous position to provide the best rowing trim for the rower as passengers and/or gear are loaded.

The flotation collar is suitably affixed to the outside surface of the hull near the gunwale stringer. The flotation collar may be one continuous piece or may be in sections to facilitate manufacture and to facilitate installation. The floation collar extends from the bow to the stern on each side of the vessel, through variations may be practiced, such as completely around the vessel, or with sections spaced at intervals. All such variations are within the scope and intent of this invention.

The pneumatic flotation means in a sponson type support affixed in a novel and unique manner to accomplish the objectives of assisting in the management of the vessel and in the improvement of the safety aspects. The flotation collar may be molded with a sealed in air quantity, such as by a blown method or a rotational molding system or other suitable technique. An alternative is to provide ordinary open air valves for direct low pressure inflation or automotive type air valves for direct high pressure inflation. All such means of providing the inflation, either at manufacture or subsequent to manufacture are within the scope and intent of this invention.

The adjustable oarlock means is such that the centerline of each oar passing through the oarlock clears the flotation collar means affixed to the sides of the vessel. The adjustable oarlock is adjustable along the gunwale of the vessel to the most suitable position in accordance with the vessel loading in order to obtain the best rowing trim.

As the oarlocks are adjustable to obtain this most suitable position to obtain the best rowing trim, it means that the person in charge can manage the loading of both passengers and gear to affect that best rowing trim. Thus, the person in charge has two components that provide means to assure safety: first, the flotation collar assures an improved safety means for a dinghy in naturally rough water or rough water from other causes; and second, having the adjustable oarlocks to select the best position for the best rowing trim, more flexibility is available to arrange the loading of passengers and gear to provide that best rowing trim.

Because of the usual small size of a dinghy, a longitudinal center seat for the rower provides the easiest means for the rower to position himself properly, for the position to which the oarlocks have been adjusted, for that best rowing trim. The alternative is an adjustable transverse seat. It is to be understood that the use of either means to utilize the adjustable oarlocks of this invention is within the scope and intent of this invention.

When the adjustable oarlocks are set at the position for best rowing trim they are fixed in place by a locking means.

It is to be noted that the flotation collar means also adds similar safety aspects when the dinghy is used as a sailboat instead of as a rowboat.

It is, therefore, an object of the invention to provide flotation collar means to improve the management of the safety aspects of a dinghy.

It is another object of the invention to provide adjustable oarlocks to permit selecting a position for the best rowing trim to further improve the management of safety of a dinghy.

It is also an object of the invention to provide adjustable oarlocks to permit management of the loading of passengers and gear to maintain the safety aspects of a dinghy.

It is still another object of the invention to provide flotation collar means to serve as a bumper means for the dinghy and other vessels to protect against damage during towing, docking, boarding, and stowing.

It is yet another object of the invention to provide flotation collar means for a dinghy to provide positive bouyancy to enable the vessel to remain afloat in the event of a capsize.

It is still another object of the invention to provide flotation means to add stability by providing a righting moment when submerged.

It is also still another object of the invention to provide a combination flotation collar means and an adjustable oarlock means to create a manageable safety dinghy when used together.

Further objects and advantages of the invention will become more apparent in the light of the following description of the preferred embodiments.

DESCRIPTION OF THE PREFERRED EMBODIMENTS

Figure 4:
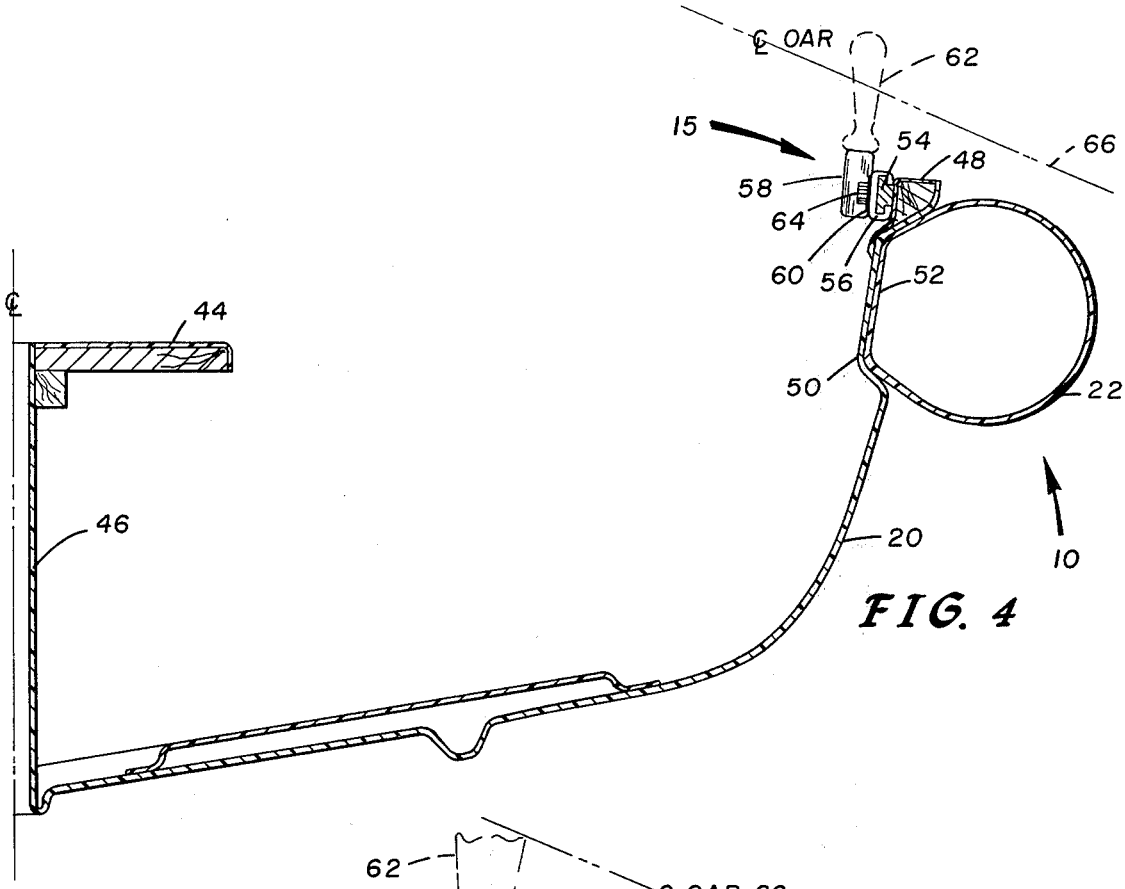
FIG. 4 is a transverse sectional view taken along section 4—4 of FIG. 2.
Figure 5:
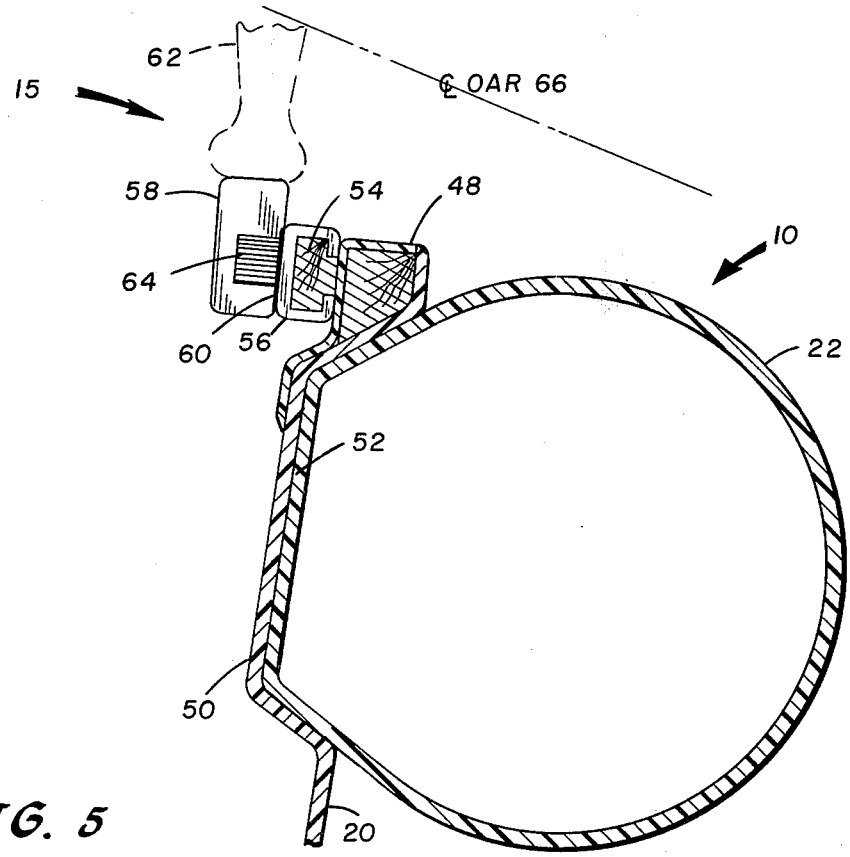
FIG. 5 is an enlarged transverse cross section view of flotation collar means and adjustable oarlock means shown as a partial view of FIG. 4.

Referring to the drawings, and particularly to FIG. 5, a flotation collar means is shown at 10 and an adjustable oarlock means is shown at 15. The flotation collar means 10 and the adjustable oarlock means 15 are shown in place on a dinghy 20 in FIGS. 1, 2, 3, and 4. It is to be understood that the use of the term dinghy in this invention for the application of a flotation collar means 10 and an adjustable oarlock means 15, is not limited to a specific vessel generally referred to as a dinghy, but is also applicable to other similar vessels used as yacht tenders or for rowing or sailing.

The flotation collar means 10 consists of a tube-like apparatus or body 22, closed at the ends 24, and fabricated from impregnated fabric, plastics materials, rubber-like materials, or other lightweight materials which are suitable for prolonged exposure to sun, normal dockside abrasion, and exposure to other weather conditions. As the flotation collar means 10 is substantially a pneumatic apparatus, it is flexible and provides the necessary protection of the vessel from damage by contact with other vessels or a dock, as well as protecting the other vessels from similar damage.

Figure 1:
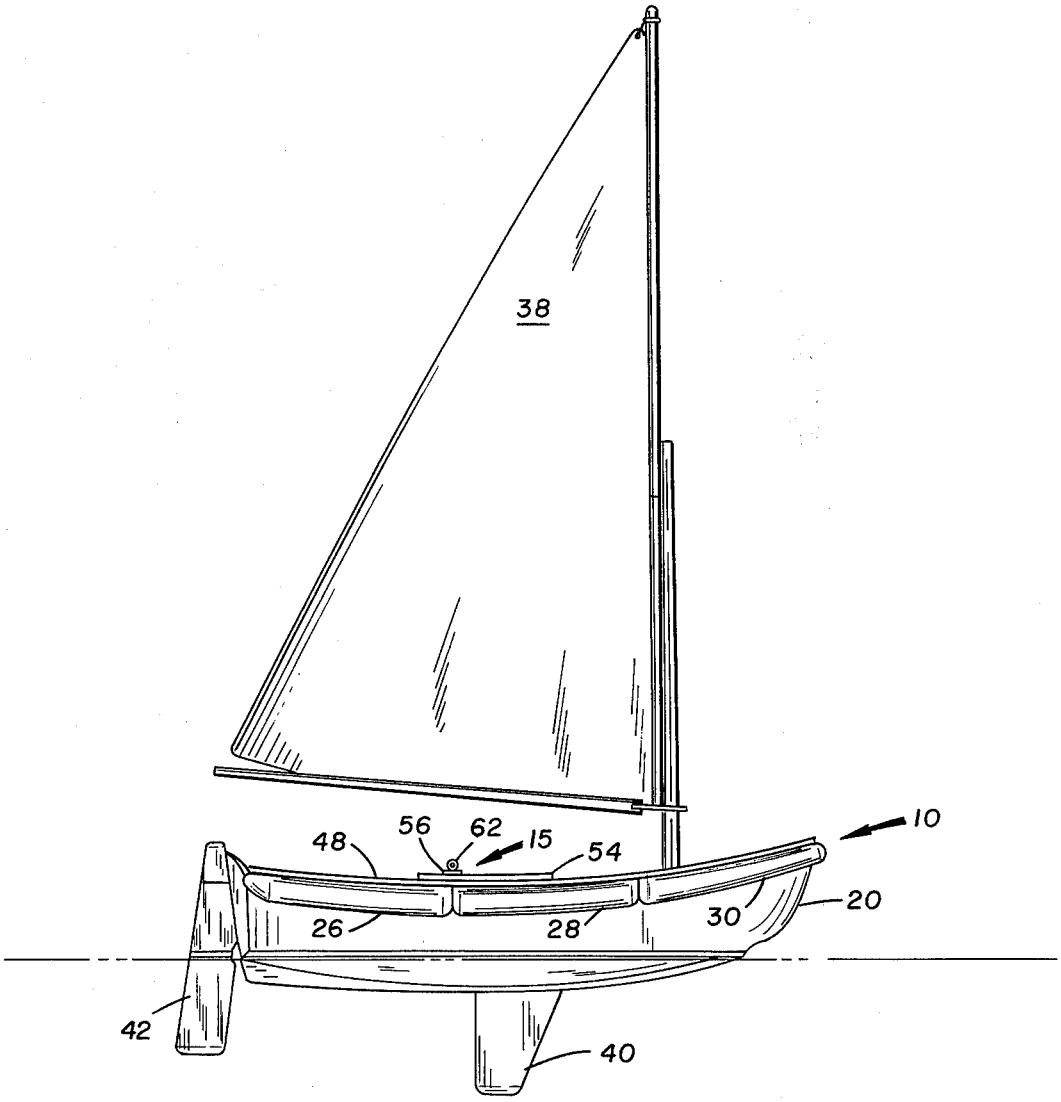
FIG. 1 is a side view of a dinghy in sailing configuration, showing flotation collar means and adjustable oarlock means.
Figure 2:
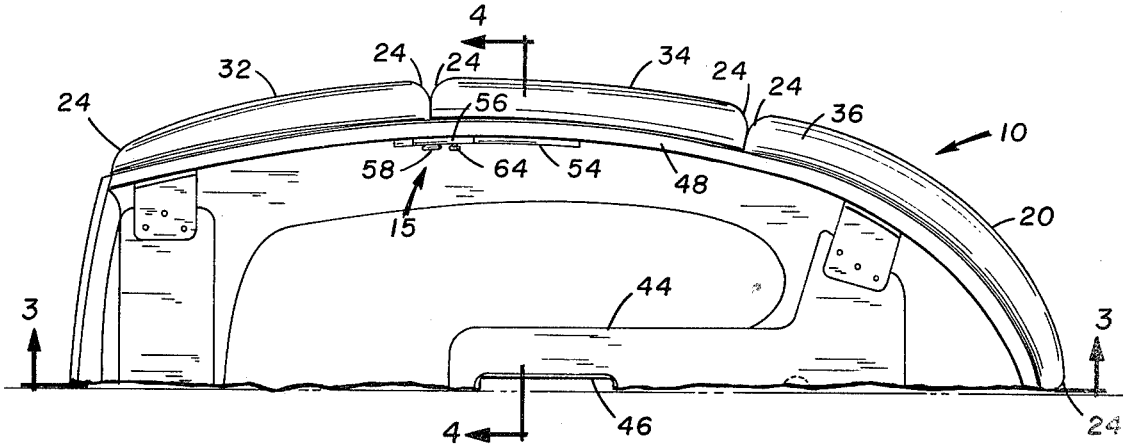
FIG. 2 is a half plan view of FIG. 1, without sail, centerboard, and rudder.
Figure 3:
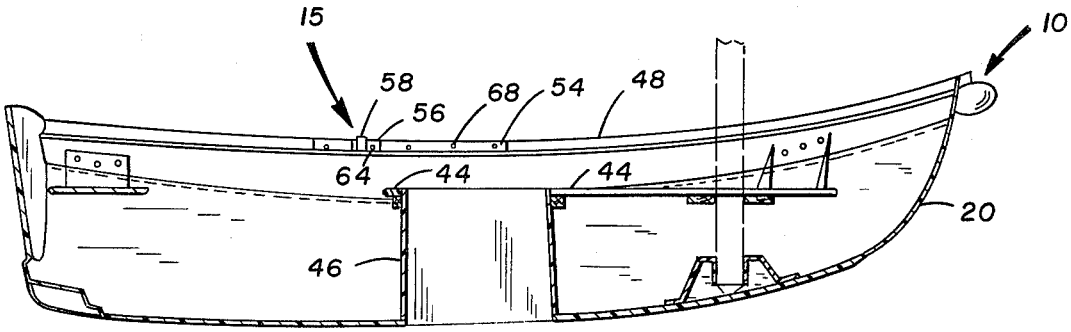
FIG. 3 is a longitudinal sectional view taken along section 3—3 of FIG. 2.

The flotation collar means 10 may be fabricated in one piece to extend the combined length of two sides of the vessel, in two sections, one for each side of the vessel, or in a plurality of sections such as sections 26, 28, 30, 32, 34, and 36, as shown in FIGS. 1 and 2 Flotation means sections 26, 28, and 30 are shown on the right or starboard side of the vessel, and flotation means sections 32, 34, and 36 are shown on the left or port side of the vessel.

It is to be understood that the plurality of flotation means sections may be any number to facilitate the application for the vessel being fitted; six flotation means sections 26, 28, 30, 32, 34 and 36 are shown in the drawings for purposes of illustration. Any variation is within the scope and intent of this invention.

Although no flotation means 10 is shown at the stern, it is to be understood that it is within the scope and intent of the invention to include a flotation means at the stern as well as on the sides if desired or needed to accomplish a specific flotation capability. In that regard it is also within the scope and intent of the invention to provide a flotation means 10 that encircles the entire vessel. For purposes of this invention specification clarity a plurality of flotation means sections 26, 28, 30, 32, 34, and 36 is illustrated as a preferred embodiment.

The flotation means 10 is applicable to a dinghy 10 or other similar vessel when used in a rowing configuration using the adjustable oarlock means 15 or when used in a sailing configuration 38 as shown in FIG. 1. The centerboard 40 and the rudder 42 in FIG. 1 are not shown in FIGS. 2, 3 and 4.

As noted hereinbefore, a longitudinal or fore and aft seat facilitates positioning the rower in the proper position when using the adjustable oarlocks 15. Such a fore and aft seat 44 is shown in FIGS. 2 and 4 surrounding the centerboard trunk 46.

The flotation collar means 10, in a plurality of flotation means sections 26, 28, 30, 32, 34, and 36, is affixed to the sides of the hull of the dinghy 20 as shown in FIGS. 1, 2, 3, and 4, with the specific detail shown in FIG. 4.

The tube-like apparatus 22 is affixed to the dinghy 20 on the outside of the hull near the gunwale 48. The tube-like apparatus 22 may be suitably affixed to the hull of a dinghy 20 of any configuration. However, for this invention a special trough-like means 50 is provided as an integral part of the hull of the dinghy 20, into which the tube-like apparatus 22 is set for affixing to the hull. The trough-like means 50 assists in holding the tube-like apparatus 22 in place and prevents weakening of the affixing means by vertically rubbing forces against the tube-like apparatus 22. Such vertical rubbing forces may occur by abrasion against a dock or another vessel or other such contact. Thus, for effective use of the flotation collar means 10, the trough-like means 50 in the dinghy 20 is an important part of the invention.

The preferred means for attaching the tube-like apparatus 22 to the trough-like means 50 in the hull of the dinghy 20, is by an adhesive means 52. The adhesive means 52 may be any suitable glue, such as an epoxy or other suitable adhesive material that adheres readily to the material from which the tube-like apparatus 22 is fabricated and also to the hull material of the dinghy 20. Other suitable means for affixing the flotation collar means 10 to the dinghy 20, such as bands around the tube-like apparatus 22 which are then fastened to the hull of the dinghy by suitable means, are within the scope and intent of this invention.

Turning now to the adjustable oarlock means 15, a cross-sectional view is shown in FIG. 4 and an enlarged cross-sectional view is shown in FIG. 5. Location views of the adjustable oarlock means 15 may be seen in FIGS. 1, 2, and 3.

The adjustable oarlock means 15 consists of a "T" shaped track means 54, a slide means 56, a pipe-like socket means 58, a fastening means 64, and an oar holder or oarlock means 62.

The "T" shaped track means 54 is affixed to the gunwale 48 by suitable means, such as by bolts or screws 68 or other similar and suitable fastening means.

The slide means 56 in the form of a "C", slides freely along the track 54. A pipe-like socket means 58 is affixed to the slide means 56 by welding 60 or by other suitable fastening means. The slide means 56 has a threaded hole through it for a fastening means 64, described hereinafter, which serves like a set screw to lock the slide means 56 to the track means 54.

A ring type or yoke type oarlock means 62 is set into the pipe-like socket means 58 to receive the oar. The rower establishes the best position for the two oarlock means (one on each side), by sliding the slide means 56 along the "T" track means 54, to provide the best rowing trim in accordance with the passenger load and gear load in the dinghy 20. When the best position is determined the slide means 56 is locked in position by tigthening the fastening means 64. Thus, the combination of the aforementioned elements becomes an adjustable oarlock means 15.

The fastening means 64 is substantially like a set screw with a thumb piece, such as a knurled knob or wings, to permit tightening manually. The screw portion of fastening means 64 thereby being forced against the "T" track means 54 to lock the slide means 56 in place. Identation means 68 in face of the T track means 54 acts as a detent.

When the oars are inserted in the oarlock means 62, the location of the combination of elements of the adjustable oarlock means 15 affixed to the gunwale 48, and the location of the flotation collar means 10 on the sides of the dinghy 20 is such that the centerline 66 of the oars clears the flotation collar means 10.

Thus, with the adjustable oarlock means 15 providing a flexibility to select the best position for the oars to give the best rowing trim, based on the loading pattern of passengers and gear, an asset is provided for managing the seating of passengers and the stowing of gear to assure and enhance the best possible safety as well as the best rowing trim.

Similarly, with the flotation collar means 10 in place on the dinghy an added safety margin is provided to give an additional flexibility in managing the seating of passengers and stowing of gear. The flotation collar means 10 providing the extra bouyancy and the aforementioned righting moment in this safety aspect.

Together, the combination of the adjustable oarlock means 15 and the flotation collar means 10 provide the necessary ingredients to make an ordinary dinghy 20 a manageable safety dinghy by providing the means whereby the loading of passengers and gear can be managed to the greatest rowing and safety advantage, with further assurances of added bouyancy and safety characteristics.

As can be readily understood from the foregoing description of the invention, the present structure can be configured in different modes to provide the ability to manage the loading of passengers and gear in a dinghy, to select the best position for oarlocks to obtain the best rowing trim, and to assure overall safety in the design and use of a dinghy.

Accordingly, modifications and variations to which the invention is susceptible may be practiced without departing from the scope and intent of the appended claims.

What is claimed is:

1. A manageable safety means for a vessel, comprising:

a vessel;

a pair of oars;

a flotation means, said flotation means being suitable affixed to the exterior surface of said vessel, said flotation means providing a positive bouyancy and stability to said vessel for safety;

a pair of oarlock means, said oarlock means being adjustable, said adjustable oarlock means being affixed to an interior surface of said vessel, said pair of oars being removably inserted into and through said pair of oarlock means, said adjustable oarlock means being positioned so as to position said oars removably inserted therein so as to clear said flotation means, said adjustable oarlock means providing a flexibility to provide the best rowing trim for said vessel and to provide a managing capability to arrange seating of passengers and stowing of gear to enhance said safety, each of said oarlock means of said pair of adjustable oarlock means consisting of a track means, said track means being located on said interior surface of the gunwale of said vessel, said track means being affixed by suitable means to said interior surface of said gunwale of said vessel, the exposed surface of said track means having a plurality of detent indentations therein, a slide means, said slide means being slidably affixed to said track means, said slide means sliding freely on said track means, said slide means having a threaded aperture therein and therethrough, a socket means, said socket means being affixed to said slide means by suitable means, a fastening means, said fastening means having a first end and a second end, said first end being cylindrical and threaded on the outside thereof, said second end having a knob-like configuration, said first end of said fastening means being removably and threadably inserted into said threaded aperture in said slide means, said knob-like configuration of said second end of said fastening means being used in manually turn said threaded end thereof in said threaded aperture to thereby tighten said fastening means against said track means and thereby locking said slide means in place, the distal end of said first end being further located when locking so as to enter one of said plurality of said detent indentation, and a pair of oarlock ring means, said oarlock ring means having a first end and a second end, said first end being configured as an open circular ring, said second end being configured as a rod-like pin, said rod-like pin being suitably affixed to the outer periphery of said open circular ring so as to project longitudinally outwardly therefrom, said oarlock ring means being removably inserted into said socket means by inserting said projecting rod-like pin portion into said socket means; and a longitudinal seat means, said longitudinal seat means running in a fore and aft direction in relation to said vessel, said longitudinal seat means being located on the longitudinal center-line of said vessel, said longitudinal seat means facilitating the positioning of a rower operating said pair of oars in said pair of adjustable oarlock means.

2. A manageable safety means for a vessel as recited in claim 1, wherein said track means is of a "T" configuration.

3. A manageable safety means for a vessel as recited in claim 1, wherein said slide means is of a "C" configuration.

4. A manageable safety means for a vessel as recited in claim 1, wherein said vessel is a dinghy type vessel, and additionally, said dinghy type vessel having a sailing capability, said flotation means also providing said positive bouyancy and said stability when in a sailing configuration, said longitudinal seat means surrounding the centerboard trunk when said dinghy type vessel has said sailing configuration.

5. A manageable safety means for a vessel as recited in claim 1, wherein said vessel is a yacht tender, said positive bouyancy provided by said flotation means enabling said vessel to remain afloat in the event of a capsize, and additionally said stability provided by said flotation means providing a righting moment when said vessel is submerged.

6. A manageable safety means for a vessel as recited in claim 1, wherein said flotation means provides a bumper facility to protect said vessel and other vessels from damage during towing, docking, boarding, and stowing operations.

7. A manageable safty means for a vessel as recited in claim 1, wherein said flotation means is a pneumatic device.

8. A manageable safety means for a vessel as recited in claim 7, wherein said flotation means is fabricated in a plurality of sections.

9. A manageable safety means for a vessel as recited in claims 7, wherein said flotation means consists of a tube-like body means, said tube-like body means being closed at the ends and fabricated from a flexible, impervious, and rubber-like material.

10. A manageable safety means for a vessel as recited in claim 9, wherein said rubber-like material is an impregnated fabric.

11. A manageable safety means for a vessel as recited in claim 9, wherein said rubber-like material is a plastic.

12. A manageable safety means for a vessel as recited in claim 9 and additionally, a trough-like recess, said trough-like recess being set into the outside surface of said vessel, said trough-like recess being open and uncovered, said trough-like recess being located immediately below and adjacent to the gunwale of said vessel, said tube-like body means of said flotation means being set into said trough-like recess, the interior of said trough-like recess being a portion of said exterior surface of said vessel, said tube-like body means being affixed to said interior of said trough-like recess as a portion of said exterior surface of said vessel.

13. A manageable safety means for a vessel as recited in claim 9 and additionally, an adhesive, said adhesive being located between said tube-like body means and said exterior surface of said vessel, said tube-like body means being thereby affixed to said vessel.

14. A manageable safety means for a vessel as recited in claim 13, wherein said adhesive is an expoxy.

* * * * *